US008248209B2

(12) United States Patent
Gobrecht et al.

(10) Patent No.: US 8,248,209 B2
(45) Date of Patent: Aug. 21, 2012

(54) DEVICE FOR COMMUNICATING BETWEEN A MOBILE ELEMENT AND A FIXED ELEMENT

(75) Inventors: Philippe Gobrecht, Labege (FR); Franck Boulle, St Maurice (FR)

(73) Assignee: Balogh, Paris (FR)

( * ) Notice: Subject to any disclaimer, the term of this patent is extended or adjusted under 35 U.S.C. 154(b) by 625 days.

(21) Appl. No.: 12/400,874

(22) Filed: Mar. 10, 2009

(65) Prior Publication Data

US 2009/0231103 A1 Sep. 17, 2009

(30) Foreign Application Priority Data

Mar. 13, 2008 (FR) ..... 08 01374

(51) Int. Cl.

| | |
|---|---|
| ***H04Q 5/22*** | (2006.01) |
| ***G05B 19/00*** | (2006.01) |
| ***G08B 13/14*** | (2006.01) |
| ***G08C 19/12*** | (2006.01) |
| ***B61L 25/00*** | (2006.01) |
| ***B61K 9/04*** | (2006.01) |
| ***H03C 5/00*** | (2006.01) |

(52) U.S. Cl. ..... 340/10.1; 340/5.61; 340/572.7; 340/13.1; 340/13.37; 246/122 R; 246/169 D; 246/182 R; 246/182 C; 246/193; 375/268; 375/320; 375/269; 375/261; 375/323

(58) Field of Classification Search ..... 340/5.61, 340/10.1, 572.7, 13.1, 13.37; 375/279, 329; 246/122 R, 169 D, 182 R, 182 C, 193, 194
See application file for complete search history.

(56) References Cited

U.S. PATENT DOCUMENTS

| | | | | |
|---|---|---|---|---|
| 4,550,444 | A * | 10/1985 | Uebel | 340/10.34 |
| 6,963,301 | B2 * | 11/2005 | Schantz et al. | 342/125 |
| 2006/0132317 | A1 * | 6/2006 | Letkomiller et al. | 340/573.1 |

FOREIGN PATENT DOCUMENTS

| | | |
|---|---|---|
| DE | 19549284 | 6/1997 |
| DE | 10314737 | 10/2004 |
| EP | 0570289 | 11/1993 |
| EP | 1227024 | 7/2002 |
| WO | 2008006803 | 1/2008 |

OTHER PUBLICATIONS

Henry J-L., "LE KVB AU SOL", Revue Generale des Chemins De Fer, Centrale Des Revues, Jan. 12, 2000, pp. 21-33, XP001246778.
French Search Report dated Nov. 4, 2008, in French application.

* cited by examiner

*Primary Examiner* — Daniel Wu
*Assistant Examiner* — Mancil Littlejohn
(74) *Attorney, Agent, or Firm* — Young & Thompson

(57) ABSTRACT

Device (D) for communicating between a mobile element and a fixed element, includes:

Figure 1:
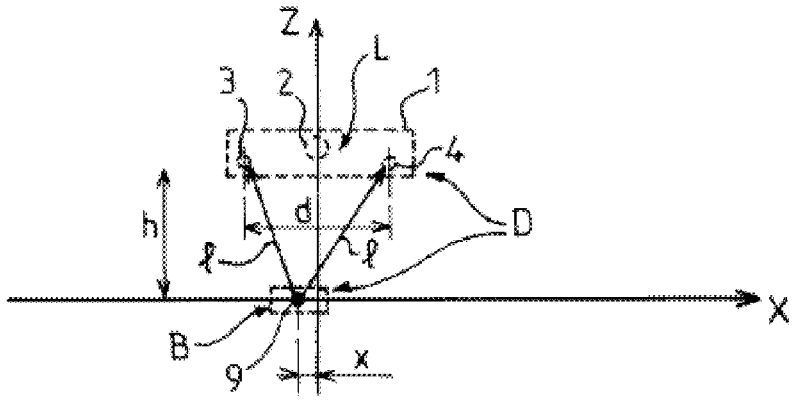

an electromagnetic field-based reader (L) including a transmitter with a transmitting antenna and a receiver with a first antenna placed in a housing (1), and a beacon (B) including a receiver able to receive a signal originating from the transmitter of the reader (L) so as to provide energy to a transmitter able to dispatch a signal received by the receiver of the reader (L), the receiver of the reader (L) including at least one second antenna and signal comparison elements able to compare the signal received by the first antenna of the receiver with the signal received by the second antenna so as to determine the moment at which the reader (L) passes vertically in line with the beacon (B).

18 Claims, 2 Drawing Sheets

DEVICE FOR COMMUNICATING BETWEEN A MOBILE ELEMENT AND A FIXED ELEMENT

The present invention pertains to a device for communicating between a mobile element and a fixed element.

The invention relates more particularly to a subassembly required for transport applications, especially for CBTC (Communications Based Train Control). CBTC is a railway management system: a central computer is responsible for managing all the trains running on the lines to be supervised. CBTC management of trains is based on communicating information between the onboard computer embedded in each of the trains and the central computer.

This guarantees effective regulation of the traffic.

By using traffic regulation, trains can be made to arrive regularly at the stations and the distance between two successive trains can be controlled. The aim is naturally to optimize the traffic and to minimize the time of arrival between each train at the station.

To meet this objective while avoiding any risk of collision, it is vital that the CBTC system be given reliable train location information.

Within this framework of transport applications, and particularly CBTC, it is therefore apparent that there is a requirement for beacons allowing readjustment of the embedded odometry and identification of a ground beacon (RFID). The information regarding distance travelled by the train must be provided to an embedded computer which will be responsible for processing the various transit pips when passing over the ground beacons.

These beacons therefore enable the embedded computer to record the position of the train as they are overflown.

The position of the train is used to carry out safety functions. The temporal safety information given by the embedded reader must be temporally consistent with the actual overflying of the beacon. Other information such as an identification message emanating from the beacon and sent to the embedded reader makes it possible to supplement the location information.

The ground beacon must be accurately tagged so that it can be programmed with location information. This beacon must be entirely passive, with no embedded energy.

The objective is to give the onboard computer the most accurate possible ground tagging information. The readjustment information must be given with an accuracy of a few centimetres, regardless of the defined conditions of use. The readjustment system must operate in an identical manner regardless of the direction of transit of the reader above the beacon: same performance forwards and backwards.

In view of certain conditions of use, especially as regards railways, it appears to be difficult to envisage solutions based on optical systems or to harness the significant directivity offered by infrared technology. Specifically, mud or dust would mask the sending of the information between the beacon and the reader.

The choice of a GPS (Global Positioning System) solution does not seem to be suitable for the readjustment solution. Specifically, the accuracies required of the order of a few centimetres are not compatible with the performance levels currently offered by such a solution. Moreover, the use of the readjustment system in tunnels also limits the attraction of the GPS solution.

The aim of the invention is above all to propose a device for communicating between a mobile element and a fixed element allowing accurate positioning of the mobile element with respect to the fixed element while meeting the constraints eluded to above.

According to the invention, a device for communicating between a mobile element and a fixed element, comprising:

an electromagnetic field-based reader comprising a transmitter with a transmitting antenna and a receiver with a first antenna placed in a housing, and a beacon comprising a receiver able to receive a signal originating from the transmitter of the reader so as to provide energy to a transmitter able to dispatch a signal received by the receiver of the reader, is characterized in that the receiver of the reader comprises at least one second antenna and signal comparison means able to compare the signal received by the first antenna of the receiver with the signal received by the second antenna so as to determine the moment at which the reader passes vertically in line with the beacon.

The comparison means may use the phases of the signals received by the first and second antennas and/or the amplitudes of the signals received by the first and second antennas.

Advantageously each of the first and second antennas comprises two windings.

Preferably, for each of the first and second antennas, one of the windings is used to determine the phase of the signal gathered by the corresponding antenna.

Preferably, for each of the first and second antennas, one of the windings is used to receive a signal, one or more arithmetic operations being carried out thereafter on at least one of the signals obtained.

The reader may be embedded in the mobile element and the beacon may be fixed.

The transmitter of the reader may operate at a frequency of around 100 kHz.

The beacon may transmit a signal at a frequency of a few MHz or a few tens of MHz.

Preferably the first and second antennas are identical.

Preferably the first and second antennas are disposed symmetrically on either side of the transmitting antenna.

Each of the first and second antennas may comprise two windings.

The transmitter of the reader may transmit continuously.

The antennas of the beacon may be disposed orthogonally to the direction of displacement of the mobile element.

The beacon might not comprise any energy source.

The invention also relates to an electromagnetic field-based reader able to be used in such a device.

Figure 2:
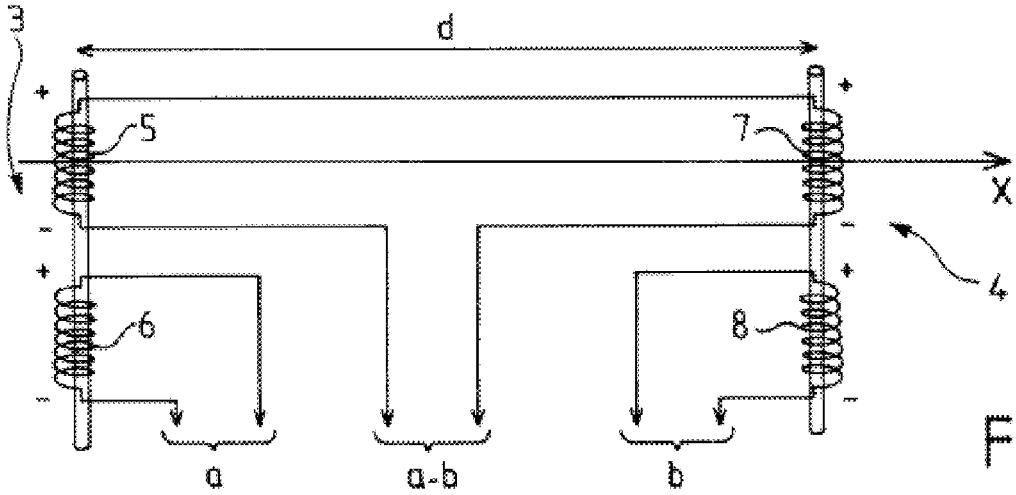
Figure 3:
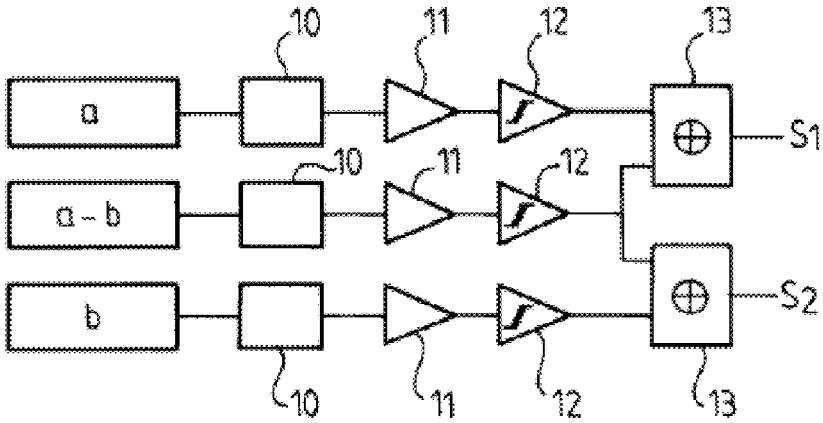
Figure 4:
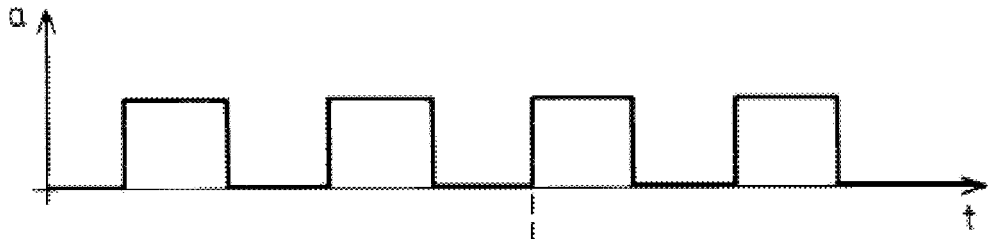
Figure 5:
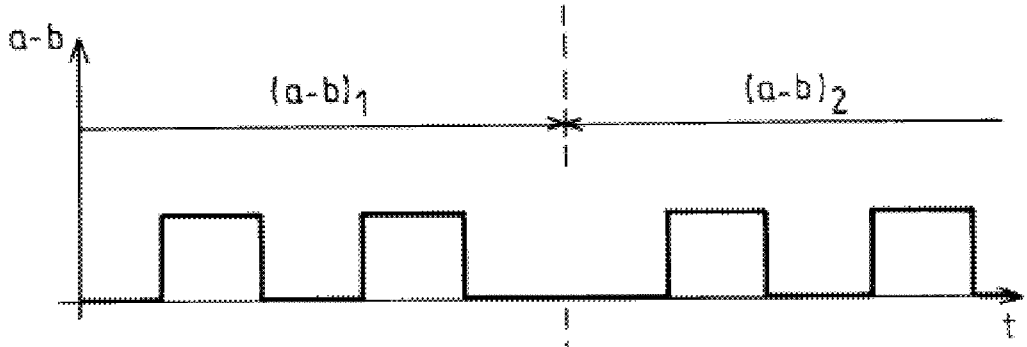
Figure 6:
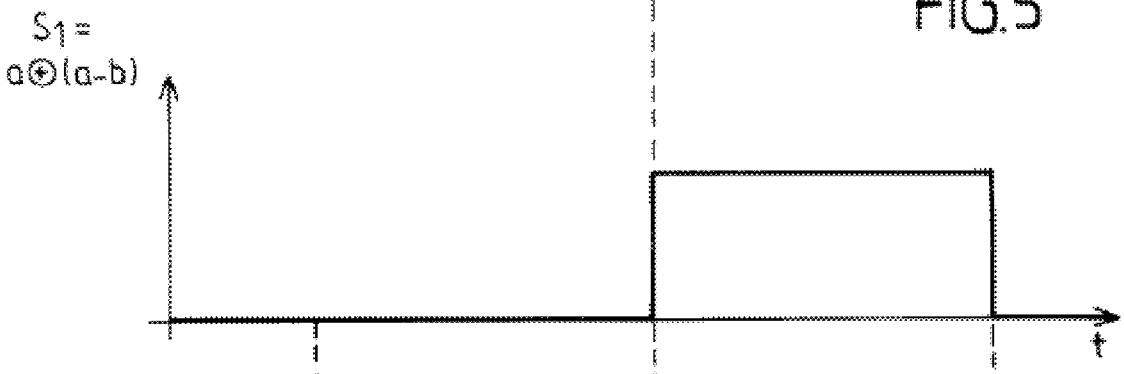
Figure 7:
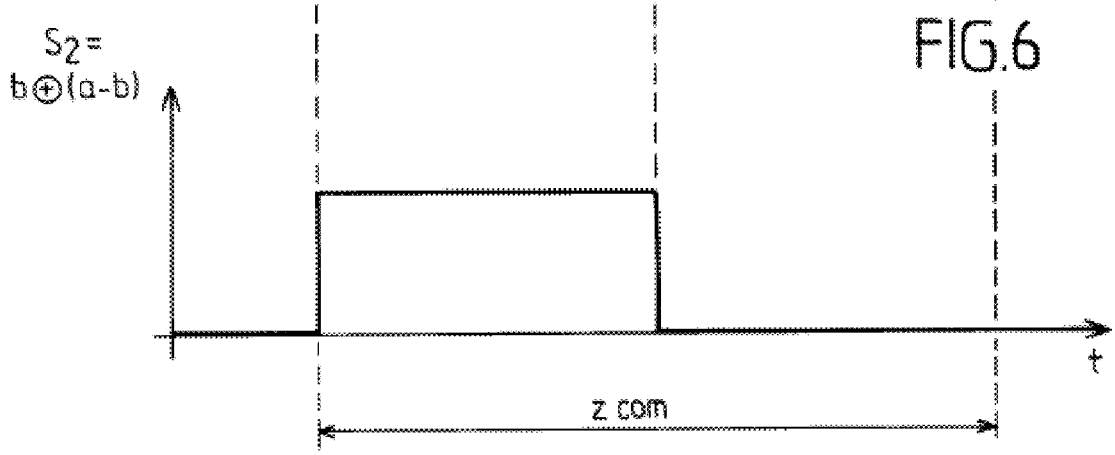

Other characteristics and advantages of the invention will become apparent in the description which follows of a preferred embodiment with reference to the appended drawings but which has no limiting character. In these drawings:

FIG. 1 is a schematic view in lateral elevation of a device according to the invention comprising a reader and a beacon, FIG. 2 is a schematic view from above, on a larger scale, representing the connections of the first and second antennas of the receiver of the reader according to FIG. 1, FIG. 3 is a schematic view of devices for processing the signals present in the reader according to FIG. 1, FIG. 4 is a schematic representation of a signal a, FIG. 5 is a schematic representation of a signal (a−b), FIG. 6 is a schematic representation of a signal S1=a ⊕ (a−b) with a different timescale along the abscissa, and FIG. 7 is a schematic representation of a signal S2=b ⊕ (a−b), according to the same timescale as in FIG. 6.

Throughout the following description of an embodiment of a communication device according to the invention, the relative terms such as "upper", "lower", "front", "rear", "horizontal" and "vertical" are to be interpreted when the reader is installed underneath a vehicle in an operating situation, in particular underneath a train, the plane of fixing of the reader being horizontal and oriented upwards while the antennas are in the bottom part.

Depicted in FIG. 1 is a reader L intended to be used in a device D according to the invention.

The various components of the reader L are placed in a housing 1 and shrouded in an insulant, not represented, based on a polymer resin. The housing 1 comprises fixing means, not represented, allowing the fixing of the housing 1 under a train.

The reader L comprises a transmitter 2 with antenna, used to transmit an electromagnetic field at a low frequency advantageously of 125 kHz but of high power, so as to provide energy to a marker or beacon B fixed on the track.

The ground beacon B must be tagged accurately so that it can be programmed with location information. This beacon B may be entirely passive, with no embedded energy.

The reader L, embedded on the train, has several roles. It must enable the ground beacon to be energized remotely so that it can operate. It must also make it possible to achieve accurate location of the train by virtue of the elements provided by the beacon B and then to send this information to an embedded computer system and to interrogate the beacon regarding its identification, and to send this identifier to the embedded computer system.

The readjustment system must enable a fixed ground reference to be taken regularly when an embedded reader passes over a fixed beacon. This beacon is accurately tagged geographically, thus allowing readjustment of the train with respect to the beacon.

One way of achieving a location pip is to detect a change of phase at the moment when the reader L passes above the beacon B.

The reader L comprises a receiver having a first and a second antenna 3 and 4 allowing the reception of the signals transmitted by the beacon B.

The ground beacon B transmits a signal that the reader L will receive, a particular combination of the antennas 3, 4 of the receiver on the reader L will make it possible to detect a change of phase when it passes above the beacon B.

The choice of the frequency domain to be used has to be determined as a function of the various criteria relating to the conditions of use and as a function of the international regulations regarding the use of frequencies.

The embodiment described here implements the 6.78 MHz frequency.

The two antennas 3 and 4 are spaced apart by a distance d in the direction of displacement of the reader L. The choice of d has an influence on the accuracy of the device.

The antennas 3 and 4 are formed by windings around horizontal ferrite bars, orthogonal to the direction of displacement of the reader L. Each antenna comprises at least two separate windings.

The windings 5 and 6 of the antenna 3 are disposed in phase opposition to the windings 7 and 8 of the antenna 4 as may be seen in FIG. 2. The signal emanating from the winding 5 is called a and the signal emanating from the winding 7 is called b. The signal a is illustrated in FIG. 4 and the signal b is similar to the signal a but comprises a phase shift of n with respect to signal a.

The wiring of the windings 5, 6, 7, 8 is illustrated in FIG. 2. The winding 5 of the antenna 3 comprises the same number of turns, but is in phase opposition with respect to the winding 7 of the antenna 4. The windings 5, 7 are linked together at one of their ends, in such a way that a signal equal to the difference a−b is obtained between the other two ends of windings 5, 7.

The winding 6 of the antenna 3 is in general identical (same number of turns, same winding direction) as the winding 5 so that the signal a is obtained at the terminals of the winding 6. However, since it is important above all to obtain the correct sign of the signal at the terminals of the winding 6, it suffices for this winding to have the same phase as the winding 5, although its number of turns could be different. Similar remarks apply to the windings 8 and 7.

The signals a, a−b and b are introduced into processing devices comprising filters 10 and amplifiers 11, 12 so as to obtain square-shaped signals that can be handled with logic circuits.

With the two antennas 3, 4 spaced a distance d apart:

when the beacon B is situated on the left, close to the first antenna 3, the first signal a emanating from the first antenna 3 will be large relative to the second signal b emanating from the second antenna 4 and the signals a and a−b will be in phase, as illustrated in FIGS. 4 and 5, whereas the signals b and a−b will be in phase opposition, that is to say there exists a 180° phase shift between them, when the beacon B is exactly at the centre of the antennas, the signal a−b will be zero, a change of phase occurring, when the beacon B is situated on the right, close to the second antenna, a change of phase will occur, a and a−b will be in phase opposition and b and a−b will be in phase.

The signal a−b therefore comprises two portions denoted $(a-b)_1$ or $(a-b)_2$ respectively. Specifically, according to FIG. 1, when the reader L is on the left of the beacon B then $(a-b)=(a-b)_1$ whilst when the reader L is on the right of the beacon B $(a-b)=(a-b)_2$.

After having been processed in this manner, the signals are input to two logic gates 13 of the "exclusive or" type also called XOR and denoted ⊕. The signals S1 and S2 emanating from these logic gates 13 are illustrated in FIGS. 6 and 7 with a smaller timescale along the abscissa. The signal S1=a ⊕ (a−b) is illustrated in FIG. 6 and the signal S2=b ⊕ (a−b) is illustrated in FIG. 7.

To illustrate the difference in abscissa timescale between FIGS. 4 and 5 on the one hand and FIGS. 6 and 7 on the other, it may be noted that the frequency of the signal a being 6.78 MHz, its period is of the order of 0.15 μs whilst the time interval zcom, visible in FIGS. 6 and 7, has a duration of around 10 ms when the train is travelling at 200 km/h.

The manner of operation is as follows.

The ground beacon B transmits a signal that the reader L will receive. The particular combination of the antennas 3, 4 on the reader L will enable the reader L to detect a change of phase as it passes over the beacon B.

The use of the signals S1 and S2 (FIGS. 6 and 7) makes it possible to exploit the change of phase and to obtain a location pip at the precise moment when the reader passes over the beacon.

The zone zcom, defined by the interval between the rising edge of S2 and the falling edge of S1, is the zone allowing communication between the beacon B and the reader L. Outside of the zone zcom, the signals a, b, S1, S2 are zero since communication is no longer possible between the beacon B and the reader L. The rising edge of S1 and the falling edge of S2 indicate the change of phase and hence the passing of the reader over the beacon B. These edges must therefore coincide. This allows redundancy and greater safety.

The signals S1 and S2 may be processed by a hardware and/or software digital device in the reader, or by a computer outside the reader L. These devices are furnished with two items of information for determining the passage of the reader over the beacon. Moreover the signals S1 and S2 give information regarding the direction of displacement of the mobile element.

For d=16 cm and h=25 cm the error in the position of the train is estimated at 1 cm independently of the speed of the train.

Another way, not illustrated in the figures, of achieving a location pip would be to have the ground beacon transmit with a known frequency and to detect the power received at this same frequency with the embedded reader.

While the reader is passing over the beacon, the power of the signal received by the antenna will vary with the distance with respect to the beacon. Specifically, the attenuation of the signal transmitted by the beacon is proportional to $1/E^3$, E being the distance between the antenna of the transmitter of the beacon and the antenna of the reader receiver.

The power as a function of x, the distance on the ground between the antennas of the beacon and of the reader, gives a maximum when the reader is above the beacon.

As a variant, instead of being effected through a change of phase, the implementation of location may be effected through a maximum in the field received with a peak detector. The moment at which the maximum is detected corresponds to the passing of the reader over the beacon.

The accuracy with which the field maximum is detected, hence the accuracy with which the reader locates the beacon, will depend on the speed of the train and the reaction time that the detection electronics may have.

When the reader under the train passes over the ground beacon, the signal exhibits a maximum. To determine the moment of this maximum, it therefore suffices to detect the moment at which the signal will begin to decrease.

This function may be implemented in an analogue or digital manner. For problems related to the safety of the system, it will be achieved in an analogue manner. This function may be achieved with a peak detector and a comparator. The comparator compares the peak signal stored by the peak detector and the signal Ve emanating directly from the antenna. As soon as Ve begins to decrease the comparator will give the flipover signal corresponding to the pip locating the passage over the beacon.

In a conventional manner a peak detector consists of a rectifier, a capacitor and a reset switch.

So as not to cause the comparator to trigger inadvertently, it is necessary to provide for a smoothing of the signal on input and a slight attenuation in the signal to be rectified.

In this way, the reaction time of the electronics is dependent on the smoothing time and accuracy of the components used.

The voltage Ve emanating from the detection carried out after antenna is, according to the distance between the antennas of the beacon and of the reader, between a few hundred mV and a few V.

With such a system, in view of the accuracy of the voltages and the smoothing time, the detection of the maximum will be done with a delay corresponding to a shift of the order of 7 cm with a speed of passage of 200 km/h. This value constitutes the system location accuracy in the case of location by detection of the field maximum.

It should be noted that the location shift due to the accuracy of the voltages is independent of the speed of the train, whereas the shift engendered by the smoothing time is directly proportional to the speed of the train.

The accuracy of the location pip could be improved since part of the error is systematic, and may form the subject of a calibration. This would lead to an accuracy of the order of 2 to 3 cm.

The invention claimed is:

1. A device (D) for communicating between a mobile element and a fixed element, comprising:

an electromagnetic field-based reader (L) comprising a transmitter with a transmitting antenna and a receiver with a first antenna placed in a housing (1); and a beacon (B) comprising a receiver able to receive a signal originating from the transmitter of the reader (L) so as to provide energy to a transmitter able to dispatch a signal received by the receiver of the reader (L), wherein, characterized in that the receiver of the reader (L) comprises i) at least one second antenna formed by windings around horizontal ferrite bars, and ii) signal comparison means able to compare the signal received by the first antenna (3) of the receiver with the signal received by the second antenna (4) so as to determine the moment at which the reader (L) passes vertically in line with the beacon (B), and each of the first antenna (3) and the second antenna (4) comprises two windings (5, 6, 7, 8), for each of the first antenna (3) and the second antenna (4), one of the two windings (6, 8) is configured to determine the phase of the signal gathered by the corresponding antenna, and for each of the first antenna 3) and the second antenna (4), one of the two windings is used to receive a signal, one or more arithmetic operations being carried out thereafter on at least one of the signals obtained, wherein said mobile element is a train, the reader is configured to be mounted horizontally underneath the train, and the first antenna and the second antenna are located in a bottom part of the housing.

2. The device (D) according to claim 1, wherein the comparison means use the phases of the signals received by the first and second antennas.

3. The device (D) according to claim 1, wherein the comparison means use the amplitudes of the signals received by the first and second antennas.

4. The device (D) according to claim 1, wherein the reader (L) is embedded in the mobile element and the beacon (B) is fixed.

5. The device (D) according to claim 1, wherein the first and second antennas are identical.

6. The device (D) according to claim 1, wherein the first and second antennas are disposed symmetrically on either side of the transmitting antenna.

7. The device (D) according to claim 1, wherein the transmitter of the reader (L) transmits continuously.

8. The device (D) according to claim 1, wherein antennas of the beacon are disposed orthogonally to the direction of displacement of the mobile element.

9. An electromagnetic field-based reader (L) configured for us in the device (D) according to claim 1.

10. A device (D) for communicating between a mobile element and a fixed element, comprising:

a housing configured for mounted horizontally underneath the train;

an electromagnetic field-based reader (L) located in a housing, the reader (L) comprising i) a transmitter (2) with an antenna, the transmitter configured to transmit an electromagnetic field of 125 kHz to provide energy to a passive ground beacon (B) fixed on train track, the ground beacon (B) having no embedded energy and being energized by the reader (L) to allow the reader (L) to interrogate the beacon as to the beacon's identification, ii) a reader comprising a first antenna (3) and a second antenna (4), the antennas arranged for reception of signals transmitted by the beacon (B), the received signals allowing the reader to detect a change of phase at the reader (L) passes the beacon (B), the first antenna (3) being spaced apart from the second antenna (4) by a distance (d) in a direction of displacement of the reader (L) when the train is moving, and iii) a signal comparison element configured to compare the signal received by the first antenna (3) with the signal received by the second antenna (4) so as to determine a moment at which the reader (L) passes vertically in line with the beacon (B), the first antenna (3) and the second antenna (4) formed by windings around horizontal ferrite bars, orthogonal to the direction of displacement of the reader (L), each of the first antenna (3) and the second antenna (4) comprising at least two separate windings, the windings (5, 6) of the first antenna (3) are disposed in phase opposition to the windings (7, 8) of the second antenna (4), one winding (5) of the first antenna (3) comprises the same number of turns, in phase opposition with respect to a corresponding one winding (7) of the second antenna (4), the one windings (5, 7) of the first and second antennas (3, 4) being linked together, at first ends thereof, such that a difference signal is obtained between the second ends of the one windings (5, 7) of the first and second antennas (3, 4), for each of the first antenna (3) and the second antenna (4), one of the two windings (6, 8) is configured to determine the phase of the signal gathered by the corresponding antenna, and for each of the first antenna (3) and the second antenna (4), one of the two windings is used to receive a signal, one or more arithmetic operations being carried out thereafter on at least one of the signals obtained.

11. The device (D) according to claim 10, wherein the comparison element uses the phases of the signals received by the first and second antennas.

12. The device (D) according to claim 10, wherein the comparison element use the amplitudes of the signals received by the first and second antennas.

13. The device (D) according to claim 10, wherein the first and second antennas are identical.

14. The device (D) according to claim 10, wherein the first and second antennas are disposed symmetrically on either side of the transmitting antenna.

15. The device (D) according to claim 10, wherein the transmitter of the reader (L) transmits continuously.

16. The device (D) according to claim 10, in combination with the beacon, and wherein antennas of the beacon are disposed orthogonally to the direction of displacement of the mobile element.

17. A device (D) for communicating between a mobile element and a fixed element, comprising:

a housing configured for mounted horizontally underneath the train;

an electromagnetic field-based reader (L) located in a housing, the reader (L) comprising i) a transmitter (2) with an antenna, the transmitter configured to transmit an electromagnetic field to provide energy to a passive ground beacon (B), the ground beacon (B) being energized by the reader (L) to allow the reader (L) to interrogate the beacon as to the beacon's identification, ii) a reader comprising a first antenna (3) and a second antenna (4), the antennas arranged for reception of signals transmitted by the beacon (B), the received signals allowing the reader to detect a change of phase at the reader (L) passes the beacon (B), the first antenna (3) being spaced apart from the second antenna (4) by a distance (d) in a direction of displacement of the reader (L) when the train is moving, iii) a signal comparison element configured to compare the signal received by the first antenna (3) with the signal received by the second antenna (4) so as to determine a moment at which the reader (L) passes vertically in line with the beacon (B), the first antenna (3) and the second antenna (4) formed by windings around horizontal ferrite bars, orthogonal to the direction of displacement of the reader (L), each of the first antenna (3) and the second antenna (4) comprising at least two separate windings, the windings (5, 6) of the first antenna (3) are disposed in phase opposition to the windings (7, 8) of the second antenna (4), one winding (5) of the first antenna (3) being in phase opposition with respect to a corresponding one winding (7) of the second antenna (4), the one windings (5, 7) of the first and second antennas (3, 4) being linked together such that a difference signal is obtained between the second ends of the one windings (5, 7) of the first and second antennas (3, 4), for each of the first antenna (3) and the second antenna (4), one of the two windings (6, 8) is configured to determine the phase of the signal gathered by the corresponding antenna, and for each of the first antenna (3) and the second antenna (4), one of the two windings is used to receive a signal, one or more arithmetic operations being carried out thereafter on at least one of the signals obtained.

18. The device (D) according to claim 17, in combination with the beacon, and wherein, the comparison element uses one of i) the phases of the signals received by the first and second antennas, and ii) the amplitudes of the signals received by the first and second antennas, the first and second antennas are disposed symmetrically on either side of the transmitting antenna, and antennas of the beacon are disposed orthogonally to the direction of displacement of the mobile element.

* * * * *